US009951517B2

(12) United States Patent
Foral

(10) Patent No.: US 9,951,517 B2
(45) Date of Patent: Apr. 24, 2018

(54) WALL ATTACHMENT CLIP, WALL PANEL SYSTEM, AND SYSTEM AND METHOD FOR SUPPORTING WALL PANELS

(71) Applicant: REDGLAZE GROUP, LLC, Omaha, NE (US)

(72) Inventor: Joseph J. Foral, Blair, NE (US)

(73) Assignee: HGI RESOURCES LLC, Omaha, NE (US)

( * ) Notice: Subject to any disclaimer, the term of this patent is extended or adjusted under 35 U.S.C. 154(b) by 0 days.

(21) Appl. No.: 14/454,132

(22) Filed: Aug. 7, 2014

(65) Prior Publication Data

US 2014/0360128 A1 Dec. 11, 2014

Related U.S. Application Data

(63) Continuation of application No. 13/553,664, filed on Jul. 19, 2012, now Pat. No. 8,813,451.

(60) Provisional application No. 61/509,109, filed on Jul. 19, 2011.

(51) Int. Cl.

| | |
|---|---|
| ***E04B 2/00*** | (2006.01) |
| ***E04B 2/82*** | (2006.01) |
| ***E04B 1/38*** | (2006.01) |
| ***E04F 13/24*** | (2006.01) |
| ***E04F 13/08*** | (2006.01) |
| ***E04F 13/12*** | (2006.01) |

(52) U.S. Cl.

CPC ..... *E04B 2/828* (2013.01); *E04B 1/38* (2013.01); *E04B 2/00* (2013.01); *E04F 13/0835* (2013.01); *E04F 13/0837* (2013.01); *E04F 13/0876* (2013.01); *E04F 13/12* (2013.01); *E04F 13/24* (2013.01); *Y10T 24/44265* (2015.01)

(58) Field of Classification Search

CPC ..... E04F 13/24; E04B 2/828

USPC .. 52/235, 588.1, 592.1, 309.8, 309.9, 404.2, 52/404.4, 511, 483.1, 475.1, 477, 539, 52/541, 302.1, 302.4, 533, 716.8, 478, 52/765, 489.2; 403/397, 169, 178; 24/292

See application file for complete search history.

(56) References Cited

U.S. PATENT DOCUMENTS

| | | | | |
|---|---|---|---|---|
| 2,966,705 A | | 1/1961 | Massey | |
| 3,777,430 A | * | 12/1973 | Tischuk | 52/309.9 |
| 3,797,190 A | * | 3/1974 | Widdowson | E04B 1/6179 52/573.1 |
| 4,037,377 A | * | 7/1977 | Howell et al. | 52/309.9 |

(Continued)

OTHER PUBLICATIONS

Centria, Metalwarp 200 Series, Feb. 2011.*

(Continued)

*Primary Examiner* — Beth A Stephan

(74) *Attorney, Agent, or Firm* — Kutak Rock LLP; Bryan P. Stanley

(57) ABSTRACT

A clip for attaching and supporting wall panels to a building (such as for an exterior building envelope), a wall panel system, and systems and methods for supporting wall panels is provided. The clip includes a main body portion, a first extension portion, a second extension portion, and a face portion. The clip is used with a system of interlocking vapor barrier wall panels to support the wall panels and affix them to a building frame without compromising the vapor barrier. Exterior façade panels can also be affixed to the clip and building frame without compromising the vapor barrier.

9 Claims, 6 Drawing Sheets

(56) References Cited

U.S. PATENT DOCUMENTS

| | | | | |
|---|---|---|---|---|
| 4,123,885 | A | 11/1978 | Scott | |
| 4,177,615 | A | 12/1979 | Anderson | |
| 4,184,301 | A | 1/1980 | Anderson et al. | |
| 4,316,351 | A | 2/1982 | Ting | |
| 4,700,520 | A | 10/1987 | Ting | |
| 4,833,854 | A | 5/1989 | Paul | |
| 5,425,210 | A | 6/1995 | Zafir | |
| 6,247,281 | B1 | 6/2001 | Lin | |
| 6,253,511 | B1 | 7/2001 | Boyer | |
| 6,627,128 | B1 * | 9/2003 | Boyer | 264/46.5 |
| 7,678,219 | B2 | 3/2010 | Thompson et al. | |
| 7,712,787 | B2 | 5/2010 | Vincenti | |
| 7,748,181 | B1 | 7/2010 | Guinn | |
| 7,895,807 | B2 | 3/2011 | Thompson et al. | |
| 8,621,810 | B2 | 1/2014 | Manser et al. | |
| 2001/0011443 | A1 | 8/2001 | Watanabe et al. | |
| 2010/0263314 | A1 * | 10/2010 | MacDonald | E04F 13/0826 52/506.05 |
| 2014/0102029 | A1 | 4/2014 | Manser et al. | |

OTHER PUBLICATIONS

Centria, Metalwarp 300 Series, Feb. 2011.*

Kingspan, http://www.kingspanpanels.us/products/commercial-industrial/karrierpanel-universal-barrier-wall-system (Accessed Jul. 10, 2014).

Centria, http://www.centriaperformance.com/products/wall/insulated_metal_back-up_panels/metalwrap/hor/100.aspx, (accessed Dec. 10, 2013).

Centria, http://eco.centria.com/images/formawall/maintDrySeal.jpg (accessed Dec. 12, 2013).

* cited by examiner

WALL ATTACHMENT CLIP, WALL PANEL SYSTEM, AND SYSTEM AND METHOD FOR SUPPORTING WALL PANELS

CROSS-REFERENCE TO RELATED APPLICATIONS

This application is a continuation of co-pending U.S. patent application Ser. No. 13/553,664, which claims priority pursuant to 35 U.S.C. 119(e) to U.S. Provisional Patent Application Ser. No. 61/509,109, filed Jul. 19, 2011, the entire disclosures of which is incorporated herein by reference.

FIELD

The present invention relates generally to the field of construction. More particularly, the present invention relates to a clip for attaching and supporting wall panels to a building (such as for an exterior building envelope), a wall panel system, and systems and methods for supporting wall panels.

BACKGROUND

An important consideration in building envelope design and construction is the air and water barrier(s) located behind the exterior facade of the building, as well as the connection of the façade over the air and water barrier(s). Traditional building envelope design (and modifications thereof) requires multi-pass installation, in which multiple separate components are sequentially installed on top of one another to achieve the thermal and moisture protection for the building interior. This typically requires a separate trade group to apply/attach each component, adding to the complication, cost, reliability and overall time needed to construct a building. Additionally, attachment of the exterior façade to the air and water barrier(s) compromises the barrier.

FIG. 1 shows a traditional, multi-component wall construction. As shown in FIG. 1, a barrier panel element 20 is attached to the outer surface of the framing studs 10 and batt insulation 15 is located in the stud cavity. A building wrap 30 is applied (typically sprayed) about the barrier panel element 20, and then the exterior façade 40 is attached by extending an anchor (such as a screw, nail, support bracket, etc.) through the wrap 30 and barrier panel element 20 and into the studs 10. This is referred to as a "triple-pass" system, in which a first trade group typically applies/installs the barrier panel element (pass 1), a second trade group applies the wrap (pass 2), and a third trade group installs the façade (pass 3). Because the exterior façade anchor extends through the wrap and barrier panel element, the air, water, vapor and thermal barrier(s) of this design is compromised. This creates an increased concern when an anchor for the exterior façade inadvertently misses a stud when it is installed in pass 3, as a hole is created in the barrier(s) that is not filled (at least in part) by the anchor (as is the case when an anchor extends into the stud).

Adoption of new building codes (such as ASHRAE 90.1-2007) has required increased energy performance requirements for building envelopes, which are not met by the traditional multi-component wall construction shown in FIG. 1. As a result, several alternative modifications of the traditional construction have been proposed and utilized to meet the newer code requirements. A first such alternative is shown in FIG. 2. As shown in FIG. 2, a barrier panel element

20 is attached to the outer surface of the framing studs 10. A building wrap 30 is applied about the barrier panel element 20, and then an insulation panel 15 is applied over the building wrap 30. Finally, the exterior façade 40 is attached by extending an anchor (such as a screw, nail, support bracket 50, etc.) through the insulation panel 15, wrap 30 and barrier panel element 20 and into the studs 10. This also is referred to as a "triple-pass" system, in which a first trade group typically applies/installs the barrier panel element (pass 1), a second trade group applies the wrap (pass 2), and a third trade group installs the insulation panel and façade (pass 3). Because the exterior façade anchor extends through the insulation panel, wrap and barrier panel element, the air, water, vapor and thermal barrier(s) of this design is still compromised. This too creates an increased concern when an anchor for the exterior façade inadvertently misses a stud when it is installed in pass 3, as a hole is created in the barrier(s) that is not filled (at least in part) by the anchor (as is the case when an anchor extends into the stud).

A second alternative to the traditional multi-component wall construction design that has been proposed to meet new code requirements is shown in FIG. 3. As shown in FIG. 3, a barrier (may include insulation functionality as well) panel element 20 is attached to the outer surface of the framing studs 10, and a spray insulation 15 is applied in the stud cavity. A building wrap 30 is applied about the barrier panel element 20, and then the exterior façade 40 is attached by extending an anchor (such as a screw, nail, support bracket, etc.) through wrap 30 and barrier panel element 20 and into the studs 10. This also is referred to as a "triple-pass" system, in which a first trade group typically applies/installs the barrier panel element (pass 1), a second trade group applies the wrap (pass 2), and a third trade group installs the façade (pass 3). Because the exterior façade anchor extends through the wrap and barrier panel element, the air, water, vapor and thermal barrier(s) of this design also is compromised. This again creates an increased concern when an anchor for the exterior façade inadvertently misses a stud when it is installed in pass 3, as a hole is created in the barrier(s) that is not filled (at least in part) by the anchor (as is the case when an anchor extends into the stud).

In an attempt to overcome one or more of the problems identified with respect to the multi-pass designs of the prior art, several "single pass" systems have been developed. Examples of such systems are shown and described in U.S. Pat. No. 7,748,181 (the '181 Patent), and in Exhibits B, C and D to U.S. provisional application No. 61/509,109 filed on Jul. 19, 2011, which depict the Invelope/Metalwrap systems by Centria, the entire disclosures of which are incorporated herein by reference. Referring to FIGS. 7 and 9 of the '181 Patent, a first single pass system includes barrier panels 106*a* and 106*b* that are interconnected together via tongue and groove type connections. The barrier panels are attached to the framing of the building and provide air, water, vapor and thermal barrier(s) for the building structure, as well as structural support for an exterior façade system. As is shown in FIG. 7, barrier panel 106*b* is attached to the stud using clip 144 and screw 146. Clip 144 includes downturned central flange portion 148 which penetrates into a foam portion of the top of panel 106*b*. The screw 146 extends through the main body portion 150 of clip 144, through panel 106*b* and into the stud. The lower end of panel 106*a* is held into position via the tongue and groove connection with panel 106*b*, and the upper end of 106*a* is attached to the stud using a clip and screw in the same manner described with respect to panel 106*b*. As is shown in FIG. 9 of the '181 Patent, a z-shaped subframe 160 is attached to the panels 106 (preferably at their horizontal joint 124) by extending screw 162 through multiple layers of steel 164-168 of the panels 106. The exterior façade panels are then attached to the z-shaped subframe via screws 172. This system is considered a single pass system in that the barrier panels and façade are typically installed by a single trade group. While this system overcomes many of the problems associated with multi-pass designs, the attachment of the subframe to support the façade panels directly to the barrier panels limits the structural support available for the façade, and also potentially exposes the foam core of the barrier panels to moisture through the holes created by the screws. Therefore, it would be beneficial to provide a system and method that allows façade panels to be supported directly by the framing of the building, and/or that does not unnecessarily expose the interior of the barrier panel to additional moisture.

Referring to Exhibits B, C and D of U.S. provisional patent application No. 61/509,109, other single pass systems are shown. The system of Exhibit B is similar to that of the '181 patent, with the façade panels supported directly to the barrier panels. The system of Exhibit C shows a clip that extends out from the barrier panels to provide horizontal support to a façade such as a brick wall. The façade of Exhibit C is supported vertically by its own structure, not by the clip or the framing of the building. The system of Exhibit D includes a zee girt attached through the barrier panels and into the stud of the building. The zee girt provides support for panels to be attached vertically. Nevertheless, the zee girt does not allow for panels to be attached horizontally as they would be to a traditional stud wall. Moreover, the zee girt system requires shims to result in proper panel alignment. Therefore, it would be beneficial to provide a system and method that allows façade panels to be supported vertically directly by the framing of the building in a horizontal manner, and/or that does not unnecessarily expose the interior of the barrier panel to additional moisture.

SUMMARY

Objects of the present inventive concept include, but are not necessarily limited to, a clip for attaching and supporting wall panels to a building (such as for an exterior building envelope), a wall panel system, and systems and methods for supporting wall panels. The system and method of the instant invention allows façade panels to be supported vertically directly by the framing of the building horizontally. In addition, the system and method of the instant invention allows façade panels to be supported without unnecessarily exposing the interior of a barrier panel to additional moisture.

The system and method of the instant invention include components manufactured in a manner similar to those of the '181 and/or of Exhibits B, C and D. In particular, in one embodiment, the system includes a barrier panel manufactured essentially identical to those shown in Exhibits B, C and D. Nevertheless, it will be appreciated that the instant invention may be utilized in connection with other components now known or hereinafter discovered.

The system includes a clip that includes a downturned central flange portion that penetrates into a foam portion at the top of an insulated steel sandwich panel (i.e. foam sandwiched between sheets of steel). A screw extends through the main body portion of the clip through pre-drilled holes in the panel, through the outer and inner metal sheets and sandwiched foam of the panel and into the stud. The lower end of the panel is held into position via the tongue and groove connection with an adjoining panel directly below the panel, and the upper end of the adjoining panel is attached to the stud using a clip and screw in the same manner described above. The clip further includes an extension portion that extends backward from the main body portion and a face portion extending generally perpendicular from the extension portion. The extension portion extends outward of the exterior surface of the panel such that a hat subgirt can be attached to the face portion of the clip via a screw that extends into a preferably pre-drilled hole in the face portion. A façade assembly is then mounted to the subgirt. The clip of the instant invention allows the panel to be attached to the stud of the exterior of the building, and provides a support for façade panels directly anchored in the studs of the building, without compromising the barrier(s) provided by the panel.

In a preferred embodiment, the clip of the instant invention is made of 14 gauge galvanized steel. Nevertheless, it will be appreciated that other suitable materials may be utilized and will be apparent to those of ordinary skill in the art.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

DESCRIPTION OF THE DRAWINGS

Preferred embodiments of the invention, illustrative of the best mode in which the applicant has contemplated applying the principles, are set forth herein and are shown in the drawings.

FIG. 5-A is a perspective view. FIG. 5-B is a top view. FIG. 5-C is a front view. FIG. 5-D is a side view.

DETAILED DESCRIPTION

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
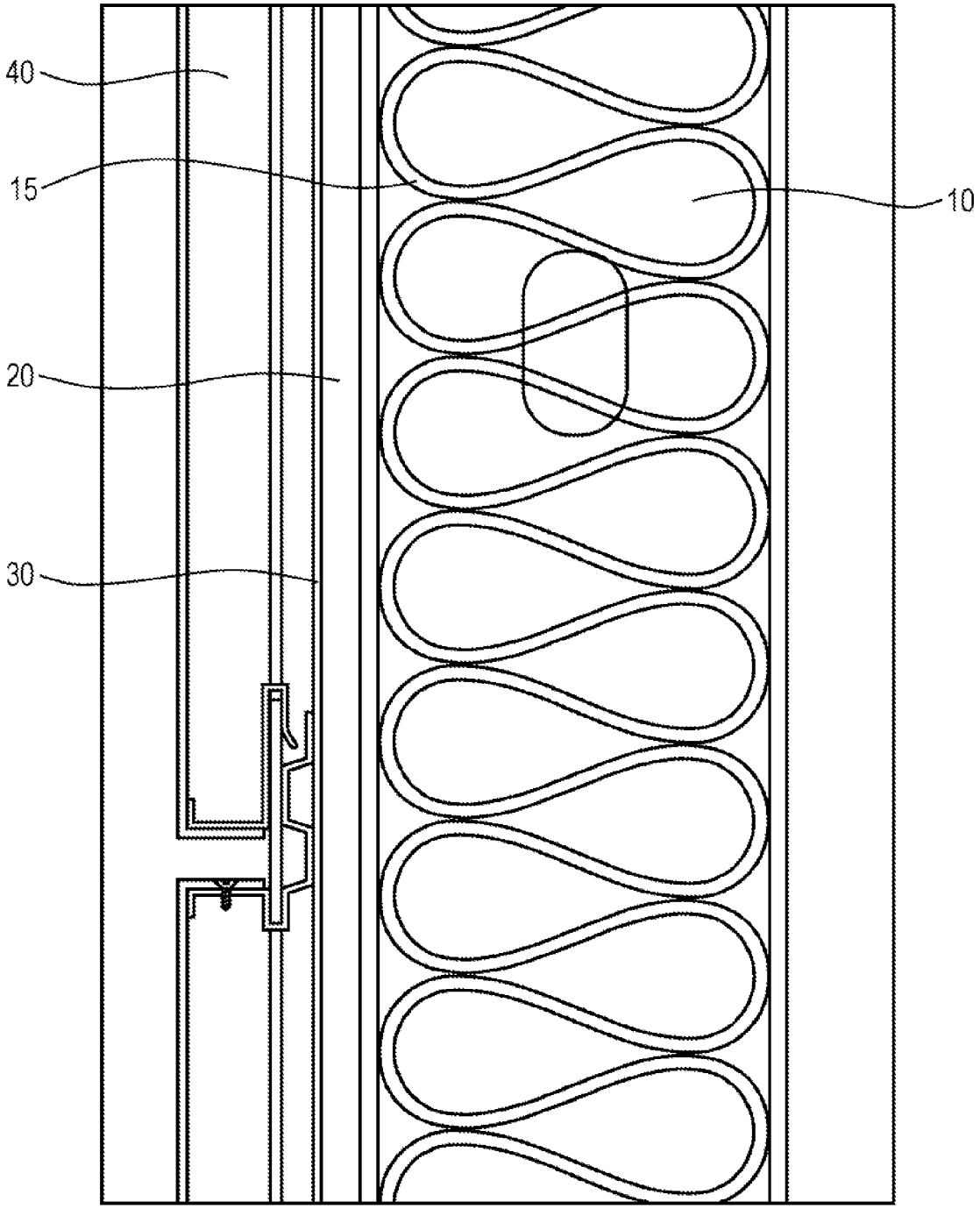
FIG. 1 (PRIOR ART)
FIG. 1 shows a cross-sectional view of a traditional multi-component wall construction of the prior art.
Figure 2:
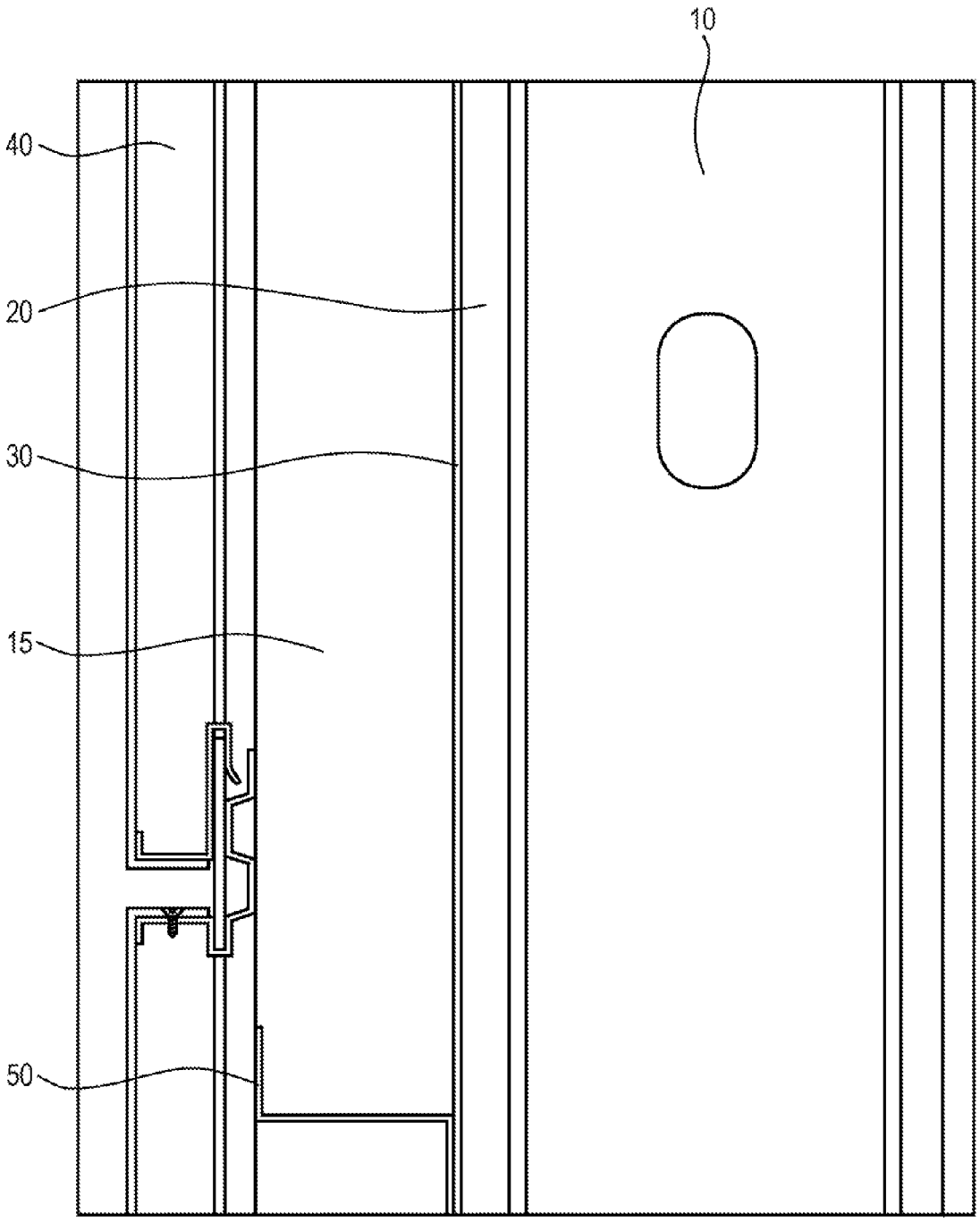
FIG. 2 (PRIOR ART)
FIG. 2 shows a cross-sectional view of a modified version of the traditional multi-component wall construction of the prior art.
Figure 3:
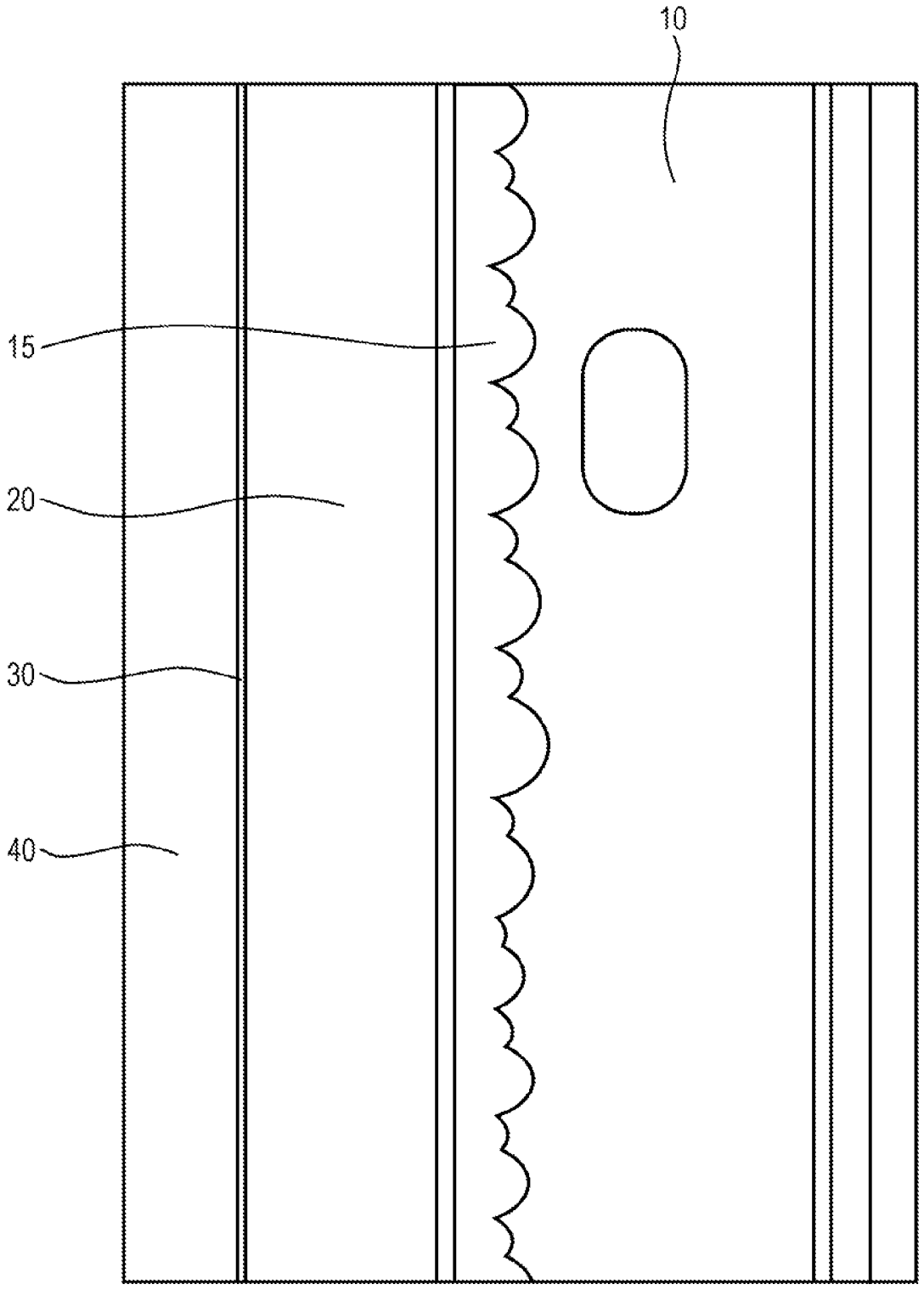
FIG. 3 (PRIOR ART)
FIG. 3 shows a cross-sectional view of another modified version of the traditional multi-component wall construction of the prior art.
Figure 4:
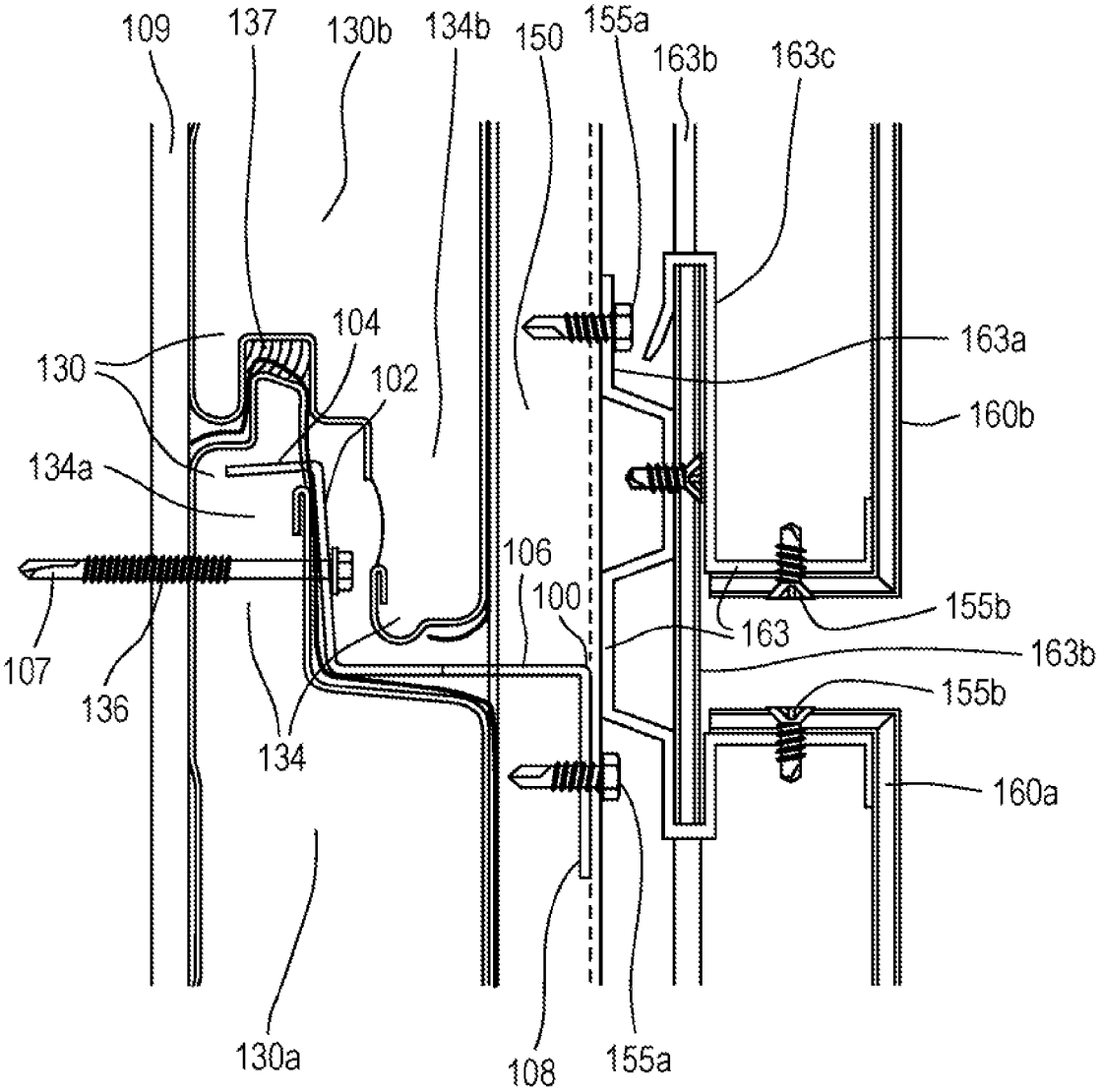
FIG. 4 shows a cross-sectional view of an embodiment of a system of the instant invention.
Figure 5:
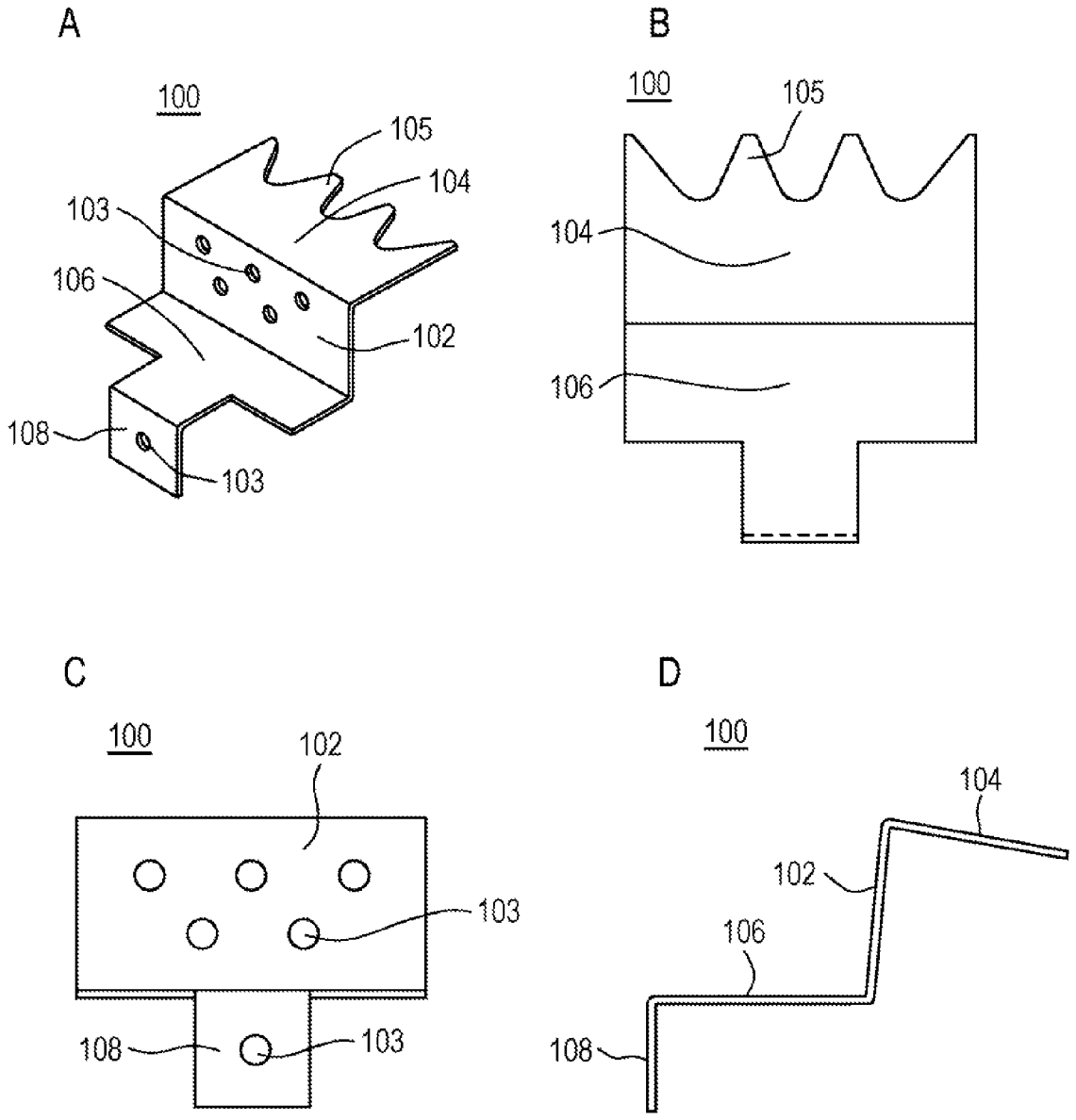
FIG. 5 shows various views of a clip of an embodiment of the instant invention.

As shown in FIGS. 4 and 5, an embodiment of a clip 100 and of a system of the instant invention utilizing clip 100 is provided. The clip 100 is used for attaching and supporting a wall panel to a building structure. The clip 100 includes a main body portion 102. Located at opposing ends of the main body portion 102, the clip 100 includes a first extension or flange portion 104 and a second extension portion 106. The first extension portion 104 and the second extension portion 106 both extend outward away from the main body portion 102 in opposite directions, with both being substantially perpendicular to the main body portion 102. At the end of the second extension portion 106, the end opposite the main body portion 102, is located a face portion 108. The face portion 108 extends outward and away from the second extension portion 106 such that it is substantially parallel with the main body portion 102, yet offset by the length of the second extension portion 106.

In the embodiment shown in FIG. 4, the first extension or flange portion 104 is used to pierce an edge 134 of a vapor barrier panel 130, such as the tongue-and-groove feature shown and described in the vapor barrier panel system of the '181 patent and/or Exhibits B, C and D of U.S. provisional patent application No. 61/509,109. The clip 100 is secured to a building framing 109 with an anchor 107 through the main body portion 102. The vapor barrier 130 is not compromised because the anchor 107 and clip 104 penetrate the panel 130*a* at an edge 134*a* that is sealed or covered by the edge 134*b* an adjacent vapor barrier panel 130*b*.

The face portion 108 is used to affix an exterior façade 160 to the exterior of the building. With the exterior façade 160 affixed to the face portion 108 of the clip 100, the exterior façade 160 is structurally supported by the building frame 109 without compromising the vapor barrier 130.

In some embodiments, the main body portion 102 includes one or more pre-drilled hole(s) 103. In an embodiment with pre-drilled holes 103 in the main body portion 102, the clip 100 is anchored to the building framing 109 through one or more of the pre-drilled hole(s) 103.

In some embodiments, the face portion 108 includes one or more pre-drilled hole(s) 103. In an embodiment with pre-drilled holes 103 in the face portion 108, the exterior façade 160 is affixed to the clip 100 through the one or more pre-drilled hole(s) 103 in the face portion 108.

In some embodiments, the first extension portion 104 includes one or more tooth 105 sized and shaped to penetrate a portion of foam insulation that is exposed in a vapor barrier panel 130 along one of the edges 134. In some embodiments, the clip 100 is a single-piece, unibody apparatus. In some embodiments, the clip 100 is made out of 14 gauge galvanized steel.

As used throughout this specification, the term "substantially perpendicular" includes any angle between 80 and 100 degrees. As used throughout this specification, the term "substantially parallel" includes any two planes wherein the smallest angle between the two planes is 15 degrees or less. For example:

In some embodiments, the first extension portion 104 is substantially perpendicular to the main body portion 102, but is slightly turned down, such that the angle between the main body portion 102 and the first extension portion 104 is slightly less than a 90 degree angle, or about 85 degrees. In some embodiments, the second extension portion 106 is substantially perpendicular to the main body portion 102, but is slightly turned down, such that the angle between the main body portion 102 and the second extension portion 106 is slightly greater than a 90 degree angle, or about 95 degrees. In an embodiment where the angle between the first extension portion 104 and the main body portion 102 is about 85 degrees and the angle between the second extension portion 106 and the main body portion 102 is about 95 degrees, the first extension portion 104 is substantially parallel to the second extension portion 106 even though they vary from being perfectly parallel by about 10 degrees.

FIG. 4 shows one embodiment of a multiple piece horizontal support bracket for façade panels. As shown in FIG. 4, a system for attaching and supporting a wall panel to a building structure is provided. The system does not compromise the vapor barrier of the building. The system includes a clip 100 for attaching and supporting a wall panel to a building structure. One example of the clip is described above and shown in FIG. 5. The system of FIG. 4 further includes a stud element 109 of a building structure. The system further includes a vapor barrier 130. The vapor barrier is formed of a plurality of interlocking panels 130*a* and 130*b*. Each panel 130*a* includes at least one edge portion 134*a* that overlaps with at least one edge portion 134*b* of an adjacent panel 130*b*.

The clip 100 is affixed to the stud element 109 of the building structure through a hole 136 in the edge portion 134*a* of a first panel 130*a*. The edge 134*b* of an adjacent panel 130*b* interlocks with the edge 134*a* of the first panel 130*a* such that the hole 136 through which the clip 100 is anchored to the stud 109 is sealed and the vapor barrier 130 is not compromised. In the vapor barrier panel system of the '181 patent and/or Exhibits B, C and D of U.S. provisional patent application No. 61/509,109, the panels 130*a* and 130*b* include interlocking tongue-and-groove edges.

As is shown in FIG. 4, a hat subgirt 150 is attached to the clip 100 by extending a screw 155 through the face portion 108 of the clip 100. The exterior façade panels 160*a* and 160*b* are then attached to the subgirt 150 via other screws 155*a*. The clip 100 is located at the top tongue section 134*a* of an insulated steel sandwich vapor barrier panel 130*a* that includes a tongue and groove interlocking system with adjacent vapor barrier panels 130*b*. A sealant material 137 is located in the tongue and groove as shown in FIG. 4. As is shown in FIG. 4, the downward central flange portion 104 of the clip 100 extends into the foam portion 134*a* of the vapor barrier panel 130*a* at a location in which the foam is exposed (i.e. the steel sheeting does not continue around the entire tongue portion of the top of the panel). The anchor 107 to attach the clip 100 extends through the steel sheet on both the exterior and interior surfaces of the vapor barrier panel 130*a* and into the stud 109.

As further shown in FIG. 4, an interior section 163*a* of the support bracket 163 is screwed to the subgirt 150. Filler strip 163*b* be is screwed to section 163*a*, and top section 163*c* is connected to filler strip 163*b* via an overlapping tongue and groove relationship. It will be appreciated that in alternative embodiments, a single piece bracket, or even direct connection of façade panels 160 to the subgirt 150 may be utilized. Furthermore, it will be appreciated that any type of façade may be attached utilizing the system of the instant invention.

Figure 6:
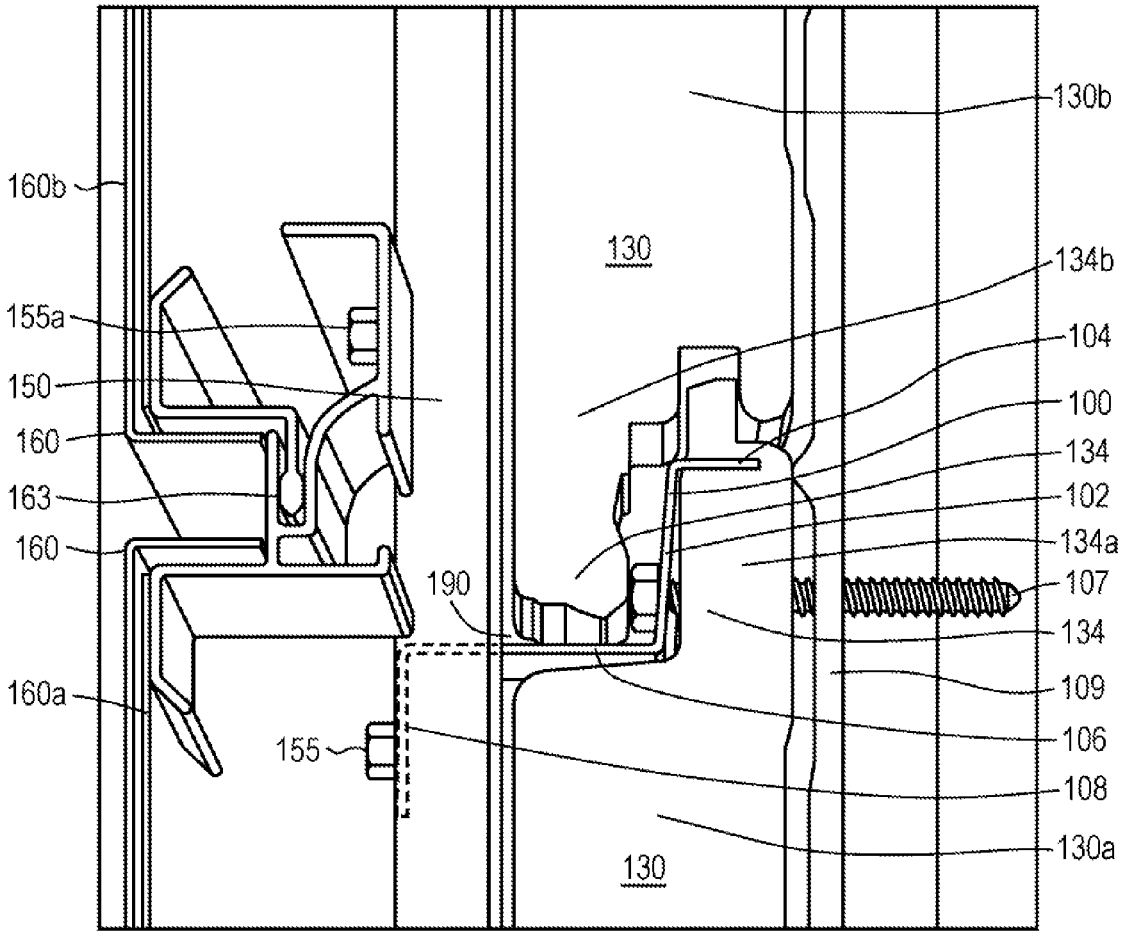
FIG. 6 shows a cross-sectional view of another embodiment of a system of the instant invention, similar to that of FIG. 4, but with a one piece bracket connecting the subgirt to the façade panels.

Referring to FIG. 6, another embodiment of a system of the instant invention, similar to that of FIG. 4, is shown with a one piece bracket connecting the subgirt to the façade panels. As is shown in FIG. 6, a hat subgirt 150 is attached to the clip 100 by extending a screw 155 through the face portion 108 of the clip 100. The exterior façade panels 160*a* and 160*b* are then attached to the subgirt 150 via screws 155*a* (not shown in FIG. 6). The clip 100 is located at the top tongue section 134*a* of an insulated steel sandwich vapor barrier panel 130*a* that includes a tongue and groove interlocking system with adjacent vapor barrier panels 130*b*. A sealant material may be located in the tongue and groove in the manner shown in FIG. 4. The downward central flange portion 104 of the clip 100 extends into the foam portion 134*a* of the vapor barrier panel 130*a* at a location in which the foam is exposed (i.e. the steel sheeting does not continue around the entire tongue portion of the top of the panel). The anchor 107 to attach the clip 100 extends through the steel sheet on both the exterior and interior surfaces of the vapor barrier panel 130*a* and into the stud 109. As further shown in FIG. 6, one-piece support bracket 163 is screwed to the subgirt 150. Bracket 163 shown in FIG. 6 is shaped as a unitary piece to receive exterior façade panels 160*a* and 160*b* and includes a filler surface similar to the filler strip 163*b* of FIG. 4 as part of the unitary piece. In the embodiment shown in FIG. 6, a separate top section fits into the one piece bracket 163 through a tongue and groove relationship. Panel 160*b* is connected to the top section, while panel 160*a* is connected to bracket 163 directly. It will be appreciated that in alternative embodiments, or even direct connection of façade panels 160 to the subgirt 150 may be utilized. Furthermore, it will be appreciated that any type of façade may be attached utilizing the system of the instant invention.

In some embodiments of the system, an exterior façade 160 is affixed to an outer portion 108 of the clip 100 such that the integrity of the vapor barrier 130 is not compromised. In some embodiments, a portion 104 of the clip 100 penetrates the edge portion 134*a* of the first panel 130*a*. In some embodiments, a pressure equalizing void 190 is maintained between the vapor barrier 130 and the exterior façade 160.

Methods for supporting wall panels are provided. The methods described herein do not compromise the vapor barrier of the wall. The method includes affixing a main body portion 102 of a clip 100 to a stud element 109 of the building structure through a hole 136 in an edge portion 134*a* of a first panel 130*a* and interlocking the first panel 130*a* with an adjacent panel 130*b* such that the hole 136 in the edge portion 134*a* of the first panel 130*a* is covered by an overlapping portion 134*b* of the adjacent panel 130*b*. The interlocking and overlapping first 130*a* and adjacent 130*b* panels form a vapor barrier 130 that is not compromised by the clip 100 which is used to support the vapor barrier panels 130*a* and 130*b* and affixed to the stud 109 of the building frame. In some embodiments, the method further includes penetrating the main body portion 102 of the clip 100, the hole 136 in the edge portion 134*a* of the first panel 130*a*, and the stud element 109 of the building structure with an anchor 107 to secure the clip 100 and panel 130*a* to the building structure. In some embodiments, the method further includes affixing an exterior façade 160 to an outer portion 108 of the clip 100 without compromising the vapor barrier 130.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration is by way of example, and the scope of the inventions is not limited to the exact details shown or described.

Although the foregoing detailed description has been described by reference to an exemplary embodiment, and the best mode contemplated for carrying out the present inventive concept has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall within the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed is:

1. A system for attaching and supporting a wall panel to a building structure, said system comprising:

a stud element of the building structure;

a barrier comprised of a plurality of interlocking panels, wherein each panel includes at least one edge portion that overlaps with at least one edge portion of an adjacent panel;

a first clip and a second clip; and a hat subgirt coupled to said first and second clips, wherein each of the first and second clips comprises:

a main body portion having a first end and a second end opposite said first end;

an extension portion having a first end located at said second end of said main body portion and extending away from the building structure in a direction substantially perpendicular to said main body portion; and a face portion located at a second end of said extension portion and extending in a direction such that said face portion and said main body portion are substantially parallel planes, wherein the interlocking panels form a vapor barrier/drain plane having a vapor barrier seal/drain plane seal along the overlapping edges;

wherein said main body portion of said first clip is nested against a first panel and is affixed to said stud element of the building structure through a hole in said at least one edge portion of said first panel such that said at least one edge portion of an adjacent second panel overlaps said hole in said first panel, such that said hole in said first panel is covered so as to maintain the vapor barrier seal, wherein said extension portion of said first clip extends between and past said first and second panels, wherein said main body portion of said second clip is nested against said second panel and is affixed to said stud element of the building structure through a hole in said at least one edge portion of said second panel such that said at least one edge portion of an adjacent third panel overlaps said hole in said second panel, such that said hole in said second panel is covered so as to maintain the vapor barrier seal, wherein said extension portion of said second clip extends between and past said second and third panels, wherein said respective face portions of said first and second clips are displaced from an outer surface of said first, second, and third panels, and wherein respective face portions and respective second ends of said extension portions of said first and second clips are positioned inside said hat subgirt.

2. The system as claimed in claim 1, further comprising:

an exterior façade affixed to the face portion of the clip such that the drain plane is not penetrated and the drain plane seal remains intact.

3. The system as claimed in claim 1, wherein said clip is affixed to said stud element of the building structure via an anchor that penetrates the main body portion of the clip, said edge portion of the first panel, and said stud element of the building structure.

4. The system as claimed in claim 2, further comprising:

a pressure equalizing void located between said vapor barrier and said exterior façade.

5. The system as claimed in claim 1, further comprising:

a sealant connects the edge of said first panel to the edge of said adjacent panel to form said vapor barrier seal.

6. A method of attaching and supporting a wall panel to a building structure, said method comprising:

affixing a first clip to a stud element of the building structure through a hole in an edge portion of a first panel;

interlocking said first panel with an adjacent panel such that said hole in the edge portion of the first panel is covered by an overlapping portion of said adjacent panel, the interlocking, overlapping first and adjacent panels forming a vapor barrier/drain plane having a vapor barrier seal/drain plane seal between said first panel and said adjacent panel;

affixing a second clip to a stud element of the building structure through a hole in an edge portion of said adjacent panel; and affixing a hat subgirt to said first and second clips, wherein said face portions and said second ends of said second extension portions of said first and second clips are positioned inside said hat subgirt.

7. The method as claimed in claim 6, further comprising affixing an exterior façade to said hat subgirt such that the vapor barrier seal remains intact and the drain plane not penetrated.

8. The method as claimed in claim 6, wherein said first and second clips each comprise:

a main body portion having a first end and a second end opposite said first end;

a second extension portion having a first end located at said second end of said main body portion and extending away from the building structure in a direction substantially perpendicular to the main body portion; and a face portion located at a second end of said second portion and extending in a direction such that said face portion and said main body portion are substantially parallel planes.

9. The method as claimed in claim 6, further comprising affixing an exterior façade to said hat subgirt such that the vapor barrier seal remains intact and the drain plane not penetrated.

* * * * *